United States Patent [19]

Krob et al.

[11] 4,449,729

[45] May 22, 1984

[54] SKI BRAKE

[75] Inventors: Erwin Krob; Helmut Bauer, both of Vienna, Austria

[73] Assignee: TMC Corporation, Baar, Switzerland

[21] Appl. No.: 327,392

[22] Filed: Dec. 4, 1981

[30] Foreign Application Priority Data

Dec. 12, 1980 [AT] Austria ..... 6049/80

[51] Int. Cl.[3] ..... A63C 7/10

[52] U.S. Cl. ..... 280/605

[58] Field of Search ..... 280/605, 604; 188/5, 188/8

[56] References Cited

U.S. PATENT DOCUMENTS

| | | | |
|---|---|---|---|
| 4,014,563 | 3/1977 | Weigl et al. | 280/605 |
| 4,108,466 | 8/1978 | Weigl et al. | 280/605 |
| 4,266,804 | 5/1981 | Murata | 280/605 |
| 4,268,060 | 5/1981 | Svoboda | 280/605 |
| 4,278,268 | 7/1981 | Szasz | 280/605 |
| 4,352,506 | 10/1982 | Svoboda et al. | 280/605 |
| 4,371,187 | 2/1983 | Svoboda et al. | 280/605 |

FOREIGN PATENT DOCUMENTS 3001250 10/1980 Fed. Rep. of Germany .

*Primary Examiner*—David M. Mitchell

*Attorney, Agent, or Firm*—Flynn, Thiel, Boutell & Tanis

[57] ABSTRACT

A ski brake having a pair of braking legs, which ski brake is pivotal by a force applied by a ski boot or by a sole plate to a pedal about an axle which extends substantially at a right angle with respect to the longitudinal axis of the ski in a mounting member which is secured to the ski, between a braking position against a spring force into a retracted position. Each braking leg has a braking mandrel with a bent segment therein which extends from the braking mandrel toward the longitudinal axis of the ski. The braking leg is held totally above the upper surface of the ski and within the width of the ski in the retracted position of the ski brake by the pedal which is stepped down upon by the ski boot or by the sole plate. In the braking position of the ski brake, the braking mandrel is held lying next to the ski edge and the braking leg projects below the running surface of the ski. The braking leg is pivotal about a swivel axle which extends in longitudinal direction of the ski when the ski brake is in the retracted position. The end of the braking leg remote from the braking mandrel is provided with a crank segment which engages a control part pivotally secured to the pedal. The control part is engageable with the upper surface of the ski as the pedal moves toward the retracted position of the ski brake to effect the aforementioned movement of the braking mandrel to a position oriented within the width of the ski.

14 Claims, 10 Drawing Figures

FIG. 1
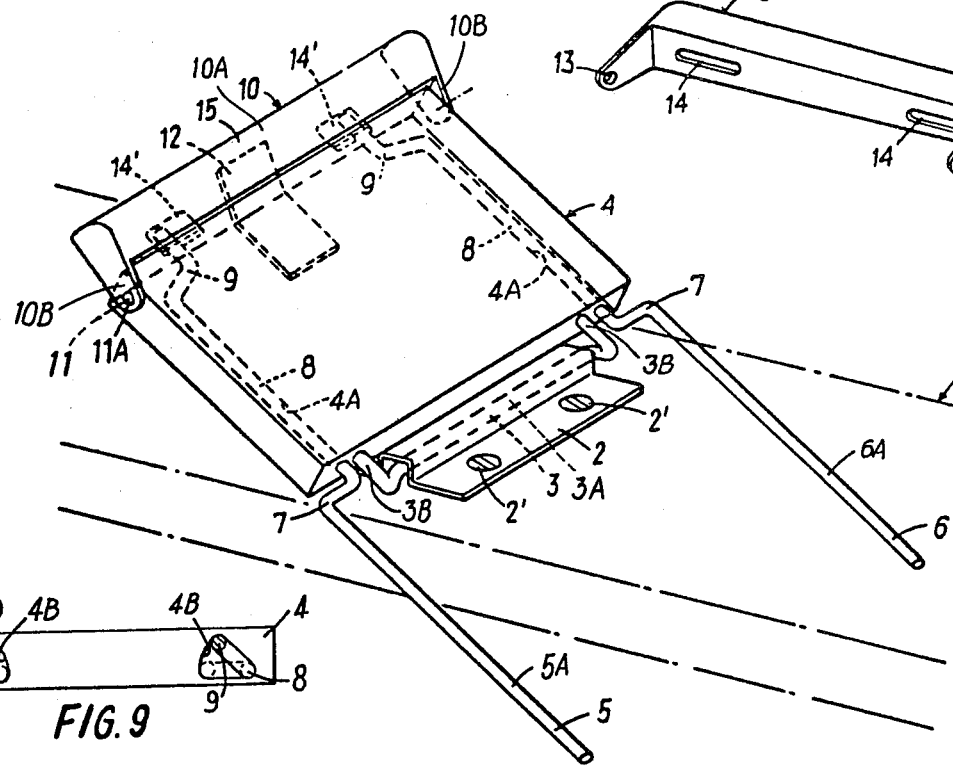
FIG. 2
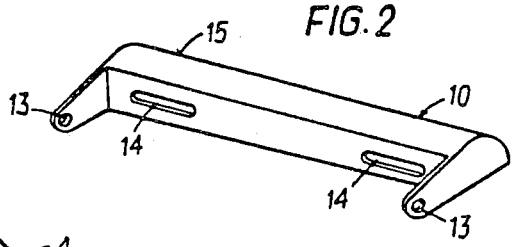
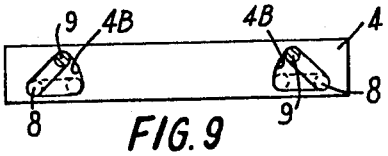
FIG. 9
FIG. 3
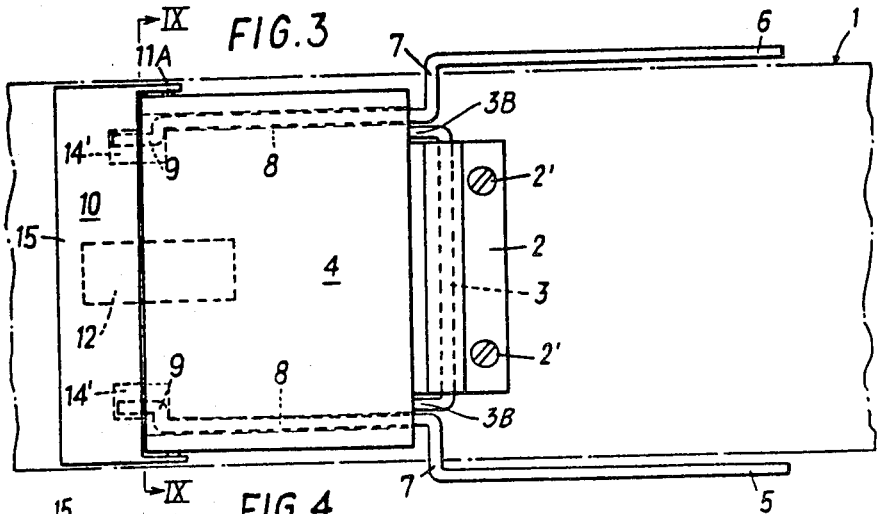
FIG. 4
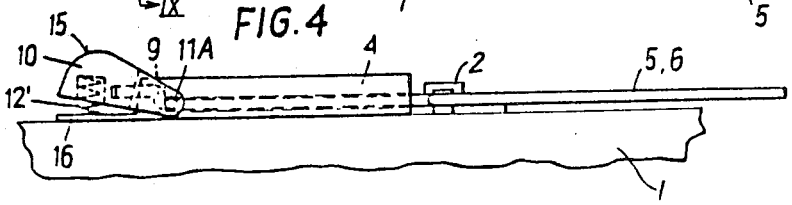

SKI BRAKE

FIELD OF THE INVENTION

The invention relates to a ski brake having two bent braking legs, both of which are pivotal about their own axis and also about an axis which extends parallel with respect to the upper side of the ski and perpendicularly with respect to the longitudinal axis of the ski, wherein the braking mandrels can be moved by means of a control part from a braking position which projects inclined from the running surface of the ski downwardly against the action of at least two springs into a retracted position, in which both braking legs are with their ends which are the lower ends in the braking position above the ski.

BACKGROUND OF THE INVENTION

In a known construction of this type (see German OS No. 29 02 318 and U.S. Pat. No. 4,268,060), the two braking legs are rotatably supported in the end regions of a shaft and are secured against an axial movement. The shaft itself is housed in a bearing block on the upper surface of the ski and is under the influence of a torsion spring which urges the braking legs into the braking position. The upper two ends of the braking legs are connected to a stepping plate hingedly secured through a further axle to a stepping bar. The stepping plate is biassed by a further torsion spring which urges the stepping plate away from the stepping bar. A leaf spring is provided on the underside of the stepping plate, which leaf spring is bent at its two ends and is secured in its center area to the stepping plate. The ends of the leaf spring have the purpose of coupling with clearance the ends of the braking legs to the stepping plate, which ends are bent in two planes which are positioned approximately normally on one another.

As long as the ski is released from the boot of the user, the two braking legs define with the underside of the ski an acute angle. However, as soon as the user steps into the binding, the two braking legs are swung into a horizontal plane, whereby, however, the stepping plate is inclined relative to the upper surface of the ski. If the pressure of the boot onto the stepping plate is increased, the two braking mandrels are swung from their horizontal position, in which the bent segments are outside of the lateral edges of the ski, into a vertically upright position, in which the bent segments are, viewed from above, inside of the lateral edges of the ski.

The two braking legs have available in this embodiment for their support only relatively short bearing holes in the shaft which, during a rough operation during skiing, quickly wear out. Furthermore, practically all elements of the ski brake, as springs, joints, etc. are not protected against accumulations of dirt due to snow and have resulted in a quick wear of the elements. If snow accumulates beneath the stepping plate during operation, the function of the ski brake is jeopardized, since the stepping plate could then no longer be pressed downwardly into its fully retracted position and thus the bent segments could then no longer be moved to their final position wherein they extend inside the lateral edges of the ski and vertically upwardly above the ski.

An object of the invention is to overcome the above-mentioned disadvantages and to provide a ski brake of the above-mentioned type, which due to the long bearing recesses for the two braking legs is of an extremely sturdy construction and in which the elements which are necessary for the control are protectively stored and are in this manner not sensitive to the effects of snow.

SUMMARY OF THE INVENTION

This object is inventively achieved primarily by the two braking legs and their bearing segments being rotatably supported in a pedal and having their bent sections projecting upwardly in the braking position, which pedal is pivotal about an axle extending perpendicularly with respect to the longitudinal axis of the ski on the upper surface of the ski and is under the influence of one spring, and by crank segments being provided at the free ends of the bearing segments and being guided in guide grooves or in slotted holes in a control part hinged to the pedal and biassed by a second spring, or several second springs which are connected in parallel. The guide grooves or the axes of the slotted holes can thereby extend parallel with respect to the underside of the control part or can define an acute angle with the underside.

A further development of the invention includes the provision of a control part which is constructed as a one-arm lever and which extends outwardly away from the pedal. The difference with respect to a conventional brake lies in the lever not being directed inwardly. This construction has the advantage that the lever rests with one surface on the underside of the sole of the ski boot. For this purpose, the surface on the lever has a radius of curvature which can be chosen as large as desired, however, in the case of the known construction, the radius of curvature is predetermined by a sleeve having a relatively small diameter, which sleeve surrounds the associated torsion spring and, at an equal load causes a higher specific surface pressure on the boot sole and thus makes sliding of the control part relative to the boot sole more difficult.

According to a further characteristic of the invention, the second spring, which may be a leaf spring, a helical spring or a resilient wire bar, is secured to the pedal. The spring urges the control part upwardly away from the ski. This arrangement makes it possible and in a simple manner, in the case that the spring is not correctly dimensioned, to replace the spring by another spring which occurs many times in the case where the torsion spring is housed in a housing. In order to thereby easily and reliably support one or several helical springs, the pedal may have inventively provided a shoulder, which forms an extension of the underside of the pedal.

Furthermore it is preferable if the control part is constructed approximately U-shaped as viewed in a top view and is hingedly secured to the pedal by the two legs of the U. This makes it possible to press the bolts defining the pivotal support into very shallow blind holes and to keep the remaining area of the pedal free, particularly the area in which the recesses for the bearing segments of the braking legs are located.

According to a further development of the invention, it is, however, also possible to construct the control part as a two-arm lever, the arms of which preferably define an angle of between 120° and 180° with one another. Here too the possibility exists to provide on the part of the support surface of the control part that engages the boot a radius of curvature which is as large as desired and moreover to house the actual control mechanism in a protected manner. The outwardly projecting lever arm has for this purpose, according to further characteristics of the invention, approximately the design of a wedge and the springs which load the control part are supported in transversely extending blind holes in the control part and are supported with their free ends which project from the holes on an inner surface of the pedal which in this area is constructed hollow. It is thereby possible for the inwardly projecting lever arm of the control part to be tapered toward its free end, and the pedal in the region of its outer end can be constructed as a housing which is rectangular in cross section. A different inventive solution provides that the pedal in the region of its outer end is substantially U-shaped in cross section and that the inwardly projecting lever arm of the control part has a thickness which is primarily constant.

BRIEF DESCRIPTION OF THE DRAWINGS

The drawings schematically illustrate several exemplary embodiments of the subject matter of the invention.

FIG. 1 is a perspective view of a first embodiment of a ski brake embodying the invention;

FIG. 2 illustrates a detail of FIG. 1, also in a perspective view;

FIG. 3 illustrates a top view of the FIG. 1 embodiment;

FIG. 4 is a side elevational view of a slightly modified embodiment;

FIG. 5 is a perspective view of a detail of a further exemplary embodiment;

FIGS. 6 to 8 illustrate the manner in which the ski brake according to FIG. 5 is moved to the retracted position during a stepping thereon by the user; and FIG. 9 is a sectional view taken along the line IX—IX of FIG. 3.

DETAILED DESCRIPTION

Figure 10:
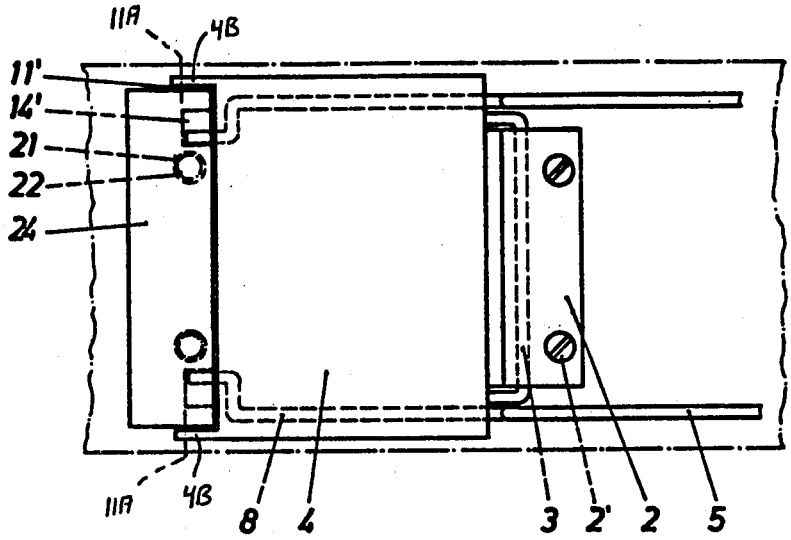
FIG. 10 is a top view similar to FIG. 3 and showing a further alternative embodiment of the ski brake of FIG. 1.

A base or mounting plate 2 is fixedly secured to the upper surface of a ski by plural fastening screws 2'. A spring wire 3 is held onto the ski by the mounting plate 2. The spring wire 3 has a laterally extending segment 3A extending beneath the mounting plate. A spring leg 3B extends upwardly on laterally opposite sides of the mounting plate. The wire spring forms at the same time the pivot axle for a pedal 4 secured to the legs 3B thereof. The pedal 4 is a plate which has generally a rectangular shape when viewed in a top view with the ski brake is in a retracted position.

A pair of laterally spaced bearing openings or recesses 4A are provided on the pedal 4 along the lateral edges thereof. A brake leg 5, 6 is provided on opposite lateral sides of the pedal 4. Each brake leg 5, 6 has a braking mandrel 5A, 6A and a bearing segment 8 separated by a bent segment 7. In this particular embodiment, the bent segments 7 each extend generally perpendicular to the longitudinal axis of the ski so that the braking mandrels can be positioned outside the lateral edges of the ski. The bearing segments 8 are received in and rotatably supported in the bearing recesses 4A. The ends of the braking legs 5, 6 remote from the braking mandrels 5A, 6A are provided with crank segments 9. Each crank segment 9 consists of a generally S-shaped wire section. The crank segments 9 are each partially received in a respective recess 4B (FIG. 9) which is provided in the pedal 4 and is sector-shaped so that the bearing segments 8 can rotate in the recesses 4A without the hindrance from the crank segments.

At the end of the pedal 4 remote from the pivot axle therefor there is provided a further pivot axle 11 arranged parallel to the first-mentioned pivot axle. The further pivot axle is defined by a pair of pins 11A projecting laterally outwardly from the pedal 4. A generally U-shaped control part 10 has a bight portion 10A and a pair of legs 10B straddling the pedal 4. Each leg 10B has a hole therethrough for receiving the pin 11A therein. The bight portion 10A of the control part 10 has on the surface which faces the pedal 4 two laterally spaced guide grooves 14' (FIG. 1) or slotted holes 14 (FIG. 2). The crank segments 9 are received in a respective one of the grooves 14, 14'. The bight portion 10A of the control part 10 is engaged by the ski boot on the side 15 thereof, which surface is curved for this purpose. The control part 10 is continuously urged by a spring 12 upwardly relative to the pedal 4, thus toward a position remote from the upper side of the ski. The spring 12, in the embodiment of FIGS. 1 to 3, is a leaf spring or a spring bar manufactured of wire. The spring can also be a helical spring 12' as shown in FIG. 4. However, it is also possible to provide plural helical springs. A shoulder 16 is provided for supporting the helical spring(s), which shoulder forms an extension of the underside of the pedal 4.

When the user steps with his or her boot into the binding, the boot sole first engages the surface 15. However, no relative movement takes place between the pedal 4 and the control part 10, especially since the initial tension of the spring 12 or the springs 12' is substantially greater than the force of the spring 3 at its erected position. Thus, the pedal 4 is swung toward the upper surface of the ski.

However, as soon as the pedal 4 rests on the upper surface of the ski 1, a swivelling of the control member 10 relative to the pedal 4 takes place, which results in a rotation of the two crank segments 9. This causes the two bearing segments 8 to be rotated in their respective bearing recess 4A arranged in the pedal 4. The bent segments 7, which are initially directed downwardly during braking, are during a stepping down on the pedal 4 moved to a position directed upwardly and above the upper surface of the ski and thence toward the longitudinal center of the ski. Thus the braking mandrels become oriented totally above the upper surface of the ski and no portion thereof projects laterally beyond the lateral edges of same.

In the exemplary embodiment according to FIGS. 5 to 8, the control part 20 is of a two-arm construction. The arms are angularly related to one another in the range of 120° to 150°. Further, the pedal 4 has a recess or opening in the end thereof adjacent the control part 20. One arm 25 of the two-arm control part 20 is received in the recess. The control part 20 and the pedal 4 each have holes or through-going holes 23 on their two lateral side surfaces, which holes serve to receive a pivot axle 11' therein for pivotally supporting the control part 20 on the pedal 4. The control part 20 has blind holes 21 on its underside 20', into which blind holes helical springs 22 are inserted. Thus, one end of the spring engages the bottom of the blind hole and the other end engages an inner surface in the recess on the pedal. Thus, the springs 22 continually urge the inwardly directed lever arm 25 upwardly away from the upper surface of the ski. The remaining details of this embodiment correspond to the embodiments of FIGS. 1 to 3. For example, the control part 20 also has on the side which faces the crank segments 9 recesses for receiving the crank segments 9 therein. When the control part 20 is a hollow member, the recesses are slotted holes 14.

The operation of the ski brake is similar to the first exemplary embodiment. Here too the pedal 4 is first swung from the upwardly projecting braking position (FIG. 6), toward the ski by the boot of the user. The outwardly directed arm 24 of the control part 20 slides thereby on the underside of the boot sole toward the tip of the ski. A relative movement between the pedal 4 and the control part 20 does not take place during this movement, since the initial tension of the springs 22 is greater than the force of the spring 3 in its end position. At the end of the swivel movement, the downwardly pointing tip of the arm 24 engages the upper surface of the ski (FIG. 7). The axes of control part 20 and pedal 4 form now an obtuse angle with each other which differs always from 180°. The two braking legs 5, 6 lie with their bent sections 7 each being in a plane which is slightly inclined with respect to the upper surface of the ski and is above the upper surface of the ski.

If now the pressure onto the pedal 4 is increased by the user, then the pedal 4 and the control part 20 are pressed into an elongated position (see FIG. 8), whereby the force of the springs 22 is overcome. The bent sections 7 of the two braking legs 5, 6 are at the same time swung from their approximately horizontal position (illustrated in FIG. 7), in which they project laterally above the upper surface of the ski 1, under the influence of the control part 20 into a vertically upright position.

The embodiment of FIG. 10 is similar to the embodiment of FIG. 1, except that the radially outer end of the pedal 4 is somewhat U-shaped and has two laterally spaced, outwardly projecting legs 4B, and the control part 24 has an end disposed between and pivotally supported on the legs 4B by means of diagrammatically indicated pins 11A. The control part 24 is similar to the control part 15 in FIG. 1, except that it preferably has a substantially constant thickness.

Of course the invention is not limited to the embodiments which are illustrated in the drawings. Many modifications are possible without departing from the scope of the invention.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski brake mountable on a ski, comprising a base; a pedal supported on said base for pivotal movement about a transversely extending, substantially horizontal first axis between a braking position in which said pedal extends upwardly at an angle to the ski and a retracted position in which said pedal is adjacent and substantially parallel to an upper surface of the ski; first resilient means for yieldably urging said pedal toward said braking position; two elongate braking members supported on said pedal, each said braking member having a first section which is rotatably supported on said pedal and extends generally radially of said first axis, a second section which is parallel to and radially offset from said first section, and a third section which connects said first and second sections in the region of said first axis, rotation of said first section of each said braking member effecting movement of said second section thereof between a first position spaced laterally outwardly of a respective side wall of the ski and a second position located laterally inwardly of such side wall, each said braking member having at an end of said first section remote from said first axis means defining a crank, each said crank including a crank segment which is radially offset from and generally parallel to said first section of such braking member; a control part supported on said pedal at an end thereof remote from said first axis for pivotal movement relative to said pedal between third and fourth positions about a second axis which is substantially parallel to said first axis, said control part having means defining two laterally spaced guide slots in a surface thereof which faces said pedal, each said guide slot receiving said crank segment of a respective said crank therein and said guide slots, in response to pivotal movement of said control part, coacting with said cranks so as to effect rotation of said first sections of said braking members; and second resilient means for yieldably urging pivotal movement of said control part about said second axis in a direction toward said third position, said second resilient means being stronger than said first resilient means so that, in response to a downward force exerted on said control part by a ski boot, said control part will remain in said third position until said pedal has been moved from said braking position substantially to said retracted position and will thereafter move from said third position to said fourth position, thereby effecting rotation of said first sections of said braking members; and wherein said control part is generally U-shaped and includes a bight and two legs, said legs straddling said end of said pedal remote from said first axis and each having an opening therein, said pedal having means defining pins on opposite sides thereof which are coaxial with said second axis and received in respective said openings in said legs of said control part for effecting said pivotal support of said control part on said pedal, said guide slots being provided in said bight of said control part.

2. The ski brake according to claim 1, wherein said second resilient means includes a leaf spring, one end of said leaf spring being secured on said pedal at said end of said pedal remote from said first axis and the other end of said leaf spring being cooperable with said control part for yieldably urging said control part toward said third position.

3. The ski brake according to claim 1, wherein said pedal has an extension at said end thereof remote from said first axis which projects outwardly away from said first axis, wherein said control part has a blind hole provided in a surface thereof which faces said extension, and wherein said second resilient means includes a helical compression spring having one end disposed in said blind hole and its other end supported on said extension on said pedal.

4. A ski brake mountable on a ski, comprising a base; a pedal supported on said base for pivotal movement about a transversely extending, substantially horizontal first axis between a braking position in which said pedal extends upwardly at an angle to the ski and a retracted position in which said pedal is adjacent and substantially parallel to an upper surface of the ski; first resilient means for yieldably urging said pedal toward said braking position; two elongate braking members supported on said pedal, each said braking member having a first section which is rotatably supported on said pedal and extends generally radially of said first axis, a second section which is parallel to and radially offset from said first section, and a third section which connects said first and second sections in the region of said first axis, rotation of said first section of each said braking member effecting movement of said second section thereof between a first position spaced laterally outwardly of a respective side wall of the ski and a second position located laterally inwardly of such side wall, each said braking member having at an end of said first section remote from said first axis means defining a crank, each said crank including a crank segment which is radially offset from and generally parallel to said first section of the braking member; a control part supported on said pedal at an end thereof remote from said first axis for pivotal movement relative to said pedal between third and fourth positions about a second axis which is substantially parallel to said first axis, said control part having means defining two laterally spaced guide slots in a surface thereof which faces said pedal, each said guide slot receiving said crank segment of a respective said crank therein and said guide slots, in response to pivotal movement of said control part, coacting with said cranks so as to effect rotation of said first sections of said braking members; and second resilient means for yieldably urging pivotal movement of said control part about said second axis in a direction toward said third position, said second resilient means being stronger than said first resilient means so that, in response to a downward force exerted on said control part by a ski boot, said control part will remain in said third position until said pedal has been moved from said braking position substantially to said retracted position and will thereafter move from said third position to said fourth position, thereby effecting rotation of said first sections of said braking members; wherein said pedal has means defining a recess extending into said pedal at said end thereof remote from said first axis, and wherein said control part has first and second arms which each extend radially outwardly from said second axis and form an angle in the range of approximately 120° to 150° with respect to each other, said first arm extending into and being movable in said recess in said pedal, said guide slots being provided in said first arm of said control part.

5. The ski brake according to claim 4, wherein said control part has a blind opening in a surface of said first arm thereof, and wherein said second resilient means includes a helical compression spring having one end disposed in said blind hole and its other end supported on a surface of said recess in said pedal.

6. The ski brake according to claim 5, wherein said first and second arms of said control part each taper in a direction away from said second axis.

7. A ski brake mountable on a ski, comprising a base; a pedal supported on said base for pivotal movement about a transversely extending, substantially horizontal first axis between a braking position in which said pedal extends upwardly at an angle to the ski and a retracted position in which said pedal is adjacent and substantially parallel to an upper surface of the ski; first resilient means for yieldably urging said pedal toward said braking position; two elongate braking members supported on said pedal, each said braking member having a first section which is rotatably supported on said pedal and extends generally radially of said first axis, a second section which is parallel to and radially offset from said first section, and a third section which connects said first and second sections in the region of said first axis, rotation of said first section of each said braking member effecting movement of said second section thereof between a first position spaced laterally outwardly of a respective side wall of the ski and a second position located laterally inwardly of such side wall, each said braking member having at an end of said first section remote from said first axis means defining a crank, each said crank including a crank segment which is radially offset from and generally parallel to said first section of the braking member; a control part supported on said pedal at an end thereof remote from said first axis for pivotal movement relative to said pedal between third and fourth positions about a second axis which is substantially parallel to said first axis, said control part having means defining two laterally spaced guide slots in a surface thereof which faces said pedal, each said guide slot receiving said crank segment of a respective said crank therein and said guide slots, in response to pivotal movement of said control part, coacting with said cranks so as to effect rotation of said first sections of said braking members; and second resilient means for yieldably urging pivotal movement of said control part about said second axis in a direction toward said third position, said second resilient means being stronger than said first resilient means so that, in response to a downward force exerted on said control part by a ski boot, said control part will remain in said third position until said pedal has been moved from said braking position substantially to said retracted position and will thereafter move from said third position to said fourth position, thereby effecting rotation of said first sections of said braking members; wherein said end of said pedal remote from said first axis is generally U-shaped and includes two laterally spaced legs which project outwardly away from said first axis and each have an opening therein, wherein a portion of said control part is disposed between said legs, and including pivot axle means coaxial with said second axis, received in said openings in said legs, and cooperable with said control part for effecting said pivotal support of said contol part on said pedal, said guide slots being provided in said portion of said control part.

8. A ski brake mountable on a ski, comprising a base; a pedal supported on said base for pivotal movement about a transversely extending, substantially horizontal first axis between a braking position in which said pedal extends upwardly at an angle to the ski and a retracted position in which said pedal is adjacent and substantially parallel to an upper surface of the ski; first resilient means for yieldably urging said pedal toward said braking position; two elongate braking members supported on said pedal, each said braking member having a first section which is rotatably supported on said pedal and extends generally radially of said first axis, a second section which is parallel to and radially offset from said first section, and a third section which connects said first and second sections in the region of said first axis, rotation of said first section of each said braking member effecting movement of said second section thereof between a first position spaced laterally outwardly of a respective side wall of the ski and a second position located laterally inwardly of such side wall, each said braking member having at an end of said first section remote from said first axis means defining a crank, each said crank including a crank segment which is radially offset from and generally parallel to said first section of the braking member; a control part supported on said pedal at an end thereof remote from said first axis for pivotal movement relative to said pedal between third and fourth positions about a second axis which is substantially parallel to said first axis, said control part having means defining two laterally spaced guide slots in a surface thereof which faces said pedal, each said guide slot receiving said crank segment of a respective said crank therein and said guide slots, in response to pivotal movement of said control part, coacting with said cranks so as to effect rotation of said first sections of said braking members; and second resilient means for yieldably urging pivotal movement of said control part about said second axis in a direction toward said third position, said second resilient means being stronger than said first resilient means so that, in response to a downward force exerted on said control part by a ski boot, said control part will remain in said third position until said pedal has been moved from said braking position substantially to said retracted position and will thereafter move from said third position to said fourth position, thereby effecting rotation of said first sections of said braking members; wherein said pedal has two laterally spaced recesses in a surface which is provided at said end thereof remote from said first axis and which faces and is adjacent said surface of said control part which faces said pedal, and wherein said pedal has two laterally spaced openings therethrough which each extend substantially radially of said first axis, terminate in a respective one of said recesses in said pedal, and rotatably support said first section of a respective one of said braking members, a portion of said crank of each said braking member being movably received in a respective said recess in said pedal.

9. The ski brake according to claim 8, wherein each said recess in said pedal is substantially sector-shaped.

10. The ski brake according to claim 8, wherein said control part is generally U-shaped and includes a bight and two legs, said legs straddling said end of said pedal remote from said first axis and each having an opening therein, said pedal having means defining pins on opposite sides thereof which are coaxial with said second axis and received in respective said openings in said legs of said control part for effecting said pivotal support of said control part on said pedal, said guide slots being provided in said bight of said control part.

11. The ski brake according to claim 10, wherein said second resilient means includes a leaf spring, one end of said leaf spring being secured on said pedal at said end of said pedal remote from said first axis and the other end of said leaf spring being cooperable with said control part for yieldably urging said control part toward said third position.

12. The ski brake according to claim 10, wherein said pedal has an extension at said end thereof remote from said first axis which projects outwardly away from said first axis, wherein said control part has a blind hole provided in a surface thereof which faces said extension, and wherein said second resilient means includes a helical compression spring having one end disposed in said blind hole and its other end supported on said extension on said pedal.

13. The ski brake according to claim 8, wherein said end of said pedal remote from said first axis is generally U-shaped and includes two laterally spaced legs which project outwardly away from said first axis and each have an opening therein, wherein a portion of said control part is disposed between said legs, and including pivot axle means coaxial with said second axis, received in said openings in said legs, and cooperable with said control part for effecting said pivotal support of said control part on said pedal, said guide slots being provided in said portion of said control part.

14. The ski brake according to claim 8, wherein said control part has a curved, generally upwardly facing surface thereon which is engageable with a ski boot, and wherein said control part extends outwardly from said pedal in a direction away from said first axis.

* * * * *